United States Patent [19]

Walker

[11] Patent Number: 4,519,894

[45] Date of Patent: May 28, 1985

[54] TREATMENT OF CARBONACEOUS SHALES OR SANDS TO RECOVER OIL AND PURE CARBON AS PRODUCTS

[76] Inventor: David G. Walker, 904 Fleetwood Dr., Baytown, Tex. 77520

[21] Appl. No.: 641,875

[22] Filed: Aug. 17, 1984

Related U.S. Application Data

[63] Continuation-in-part of Ser. No. 554,066, Nov. 2, 1983, abandoned.

[51] Int. Cl.[3] ..... C10G 1/00; C10G 1/04

[52] U.S. Cl. ..... 208/11 R; 208/8 R; 423/449; 423/459

[58] Field of Search ..... 208/8 R, 11 R; 423/459, 423/449

[56] References Cited

U.S. PATENT DOCUMENTS

| | | | |
|---|---|---|---|
| 4,392,942 | 7/1983 | Wallman et al. | 208/11 R |
| 4,399,314 | 8/1983 | Child | 208/11 LE |
| 4,404,086 | 9/1983 | Oltrogge | 208/11 R |
| 4,431,509 | 2/1984 | Tarman | 208/8 R |
| 4,435,271 | 3/1984 | Deering et al. | 208/11 R |
| 4,439,306 | 3/1984 | Voetter et al. | 208/11 R |

*Primary Examiner*—G. L. Kaplan

[57] ABSTRACT

A carbon-containing solid (such as oil shale or tar sand) is treated with air in a six-stage vertical shaft to make producer gas, oil and a pure carbon as products. The top and bottom stages of the vertical shaft are fed to pre-heat incoming solid and to scavenge sensible heat from the processed solid. One stage is a direct retort and makes a gas stream which is a mixture of producer gas and oil. Another stage is a gas producer which converts fixed carbon on the solid to carbon monoxide by reaction with air and carbon dioxide. A fifth stage preheats incoming air. The sixth stage cools and purifies hot carbon monoxide-rich producer gas.

The oil and producer gas products are made by direct retorting of the solid with air followed by a separation step. The pure carbon product is made by separating pure carbon monoxide from the carbon monoxide-rich producer gas followed by reacting the carbon monoxide to carbon dioxide and the pure carbon product.

2 Claims, 2 Drawing Figures

TREATMENT OF CARBONACEOUS SHALES OR SANDS TO RECOVER OIL AND PURE CARBON AS PRODUCTS

This is a continuation-in-part of application Ser. No. 554,066, filed 11/2/83 now abandoned.

BACKGROUND OF THE INVENTION

Carbon-containing solids such as oil shale or tar sand are wide-spread in nature and the known deposits contain vast amounts of potential energy. All of the previously known methods for treating these solids make only oil as an economically transportable product. The potential energy of the solid which is not converted to oil ends up as a combustion gas (producer gas or retort gas), or as combustion heat, or as a non-volatile coke deposited on the processed solid.

Producer gas or retort gas can be transported economically for only short distances. Combustion heat must be either used at the site of combustion or else discarded. Non-volatile carbon on the treated solid is necessarily wasted when the solid is discarded.

The amount of carbonaceous residue remaining after pyrolysis of oil shales or tar sands varies with the material treated. The richest of Colorado shales leave about 20% of the original carbon in the treated (retorted) shale. Devonian shales of Kentucky normally leave more than 50% of the original carbon in the discarded shale. Coaly shales and sands exist which leave more than 80% of the original carbon on the waste solids from pyrolysis retorting. These last materials are not now considered potential resources at all since they yield little oil upon pyrolysis.

The treatment of carbon-containing solids entails costly mining and processing of much more inert material than the end products. It is highly desirable to obtain as high a yield as possible of high-grade transportable products in order to lower the unit product costs of mining and processing.

BRIEF SUMMARY OF THE INVENTION

This invention processes carbon-containing solids so as to produce two economically-transportable products: oil and pure carbon (tar, pitch, sulfur and ash-free). The oil product is of similar quality and quantity as obtained by previous technology. The pure carbon product represents an additional quantity of high-grade energy which is not made by previous technology.

This carbon product represents an important product yield increase over conventional processes which recover only oil as a high-grade energy product. This yield increase may be as low as 25% for the richest Colorado shales, 100% for typical Kentucky Devonian shales and more than 500% for coaly solids. In many cases, pure carbon is the major product while oil is only a by-product.

The process of this invention is:

(1) Crushed carbon-containing solid is fed top to bottom of a vertical shaft which is divided into six stages. Each stage of the shaft has a gas stream feed at the stage bottom and a gas product stream leaving the top of the stage.

(2) After a pre-heating stage, the solid is pyrolyzed-burned in a gas producer stage to produce an oil vapor mixed in a producer gas exit stream.

(3) The pyrolized solid is then passed through another gas producer stage where the remaining carbon of the solid is converted into carbon monoxide by reaction with air and carbon dioxide.

(4) The carbon monoxide-rich producer gas from (3) is cooled and purified in another stage of the vertical shaft.

(5) The producer gas of (4) is separated into a pure carbon monoxide stream and an inert gas stream consisting mostly of nitrogen and carbon dioxide. (See pages 788–93 of the *Encyclopedia of Chemical Technology*, 3rd Ed. ., Vol. 4 and the references cited therein.

(6) Carbon monoxide is then reacted to carbon dioxide and the product carbon in a Boudouard Reactor. (See U.S. Pat. No. 4,185,083, Jan. 22, 1980 by David G. Walker).

(7) The solid pure carbon product is separated from the carbon dioxide gas which is recycled to step (3) of this process sequence.

THE DRAWING

FIG. 1 shows an arrangement of apparatus and a processing sequence in which the method of this invention can be carried out. The apparatus shown in FIG. 1 comprises: a six-stage vertical shaft 1, a unit for the cooling and separation of oil from gas 6 A carbon monoxide separation unit 3 and a Boudouard Reactor 11 which converts carbon monoxide to carbon dioxide and carbon.

Further information concerning FIG. 1 is set forth below.

DETAILED DESCRIPTION

Figure 1:
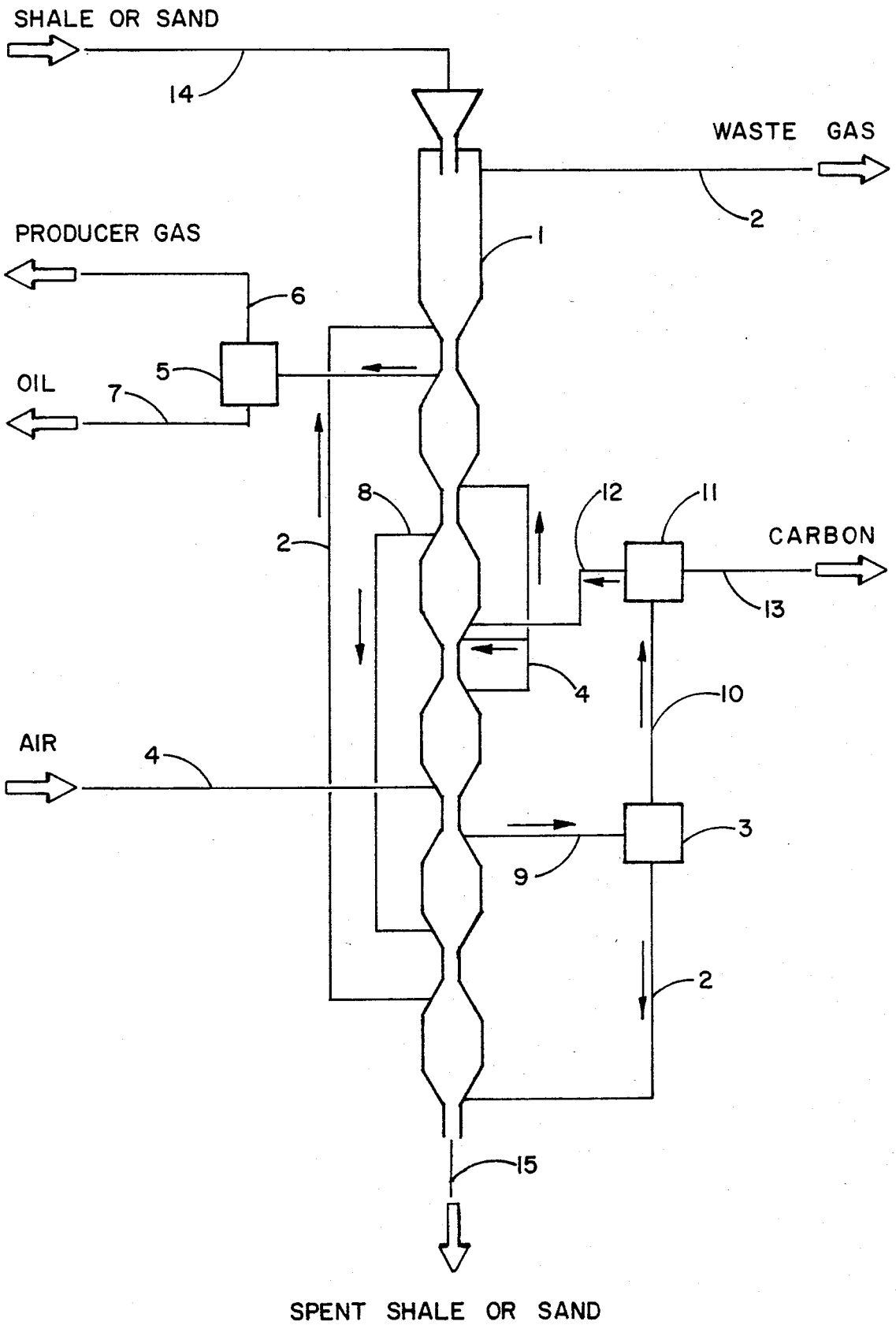

A carbon-containing solid (oil shale or tar sand), which has been crushed and screened to reject all lumps bigger than 7 cm. diameter, 14, is fed to the top of a vertical shaft 1. The vertical shaft is divided into six stages. The stages consist of wide areas of the shaft and are separated from each other by narrow shaft regions through which the solid may pass downward through the stages in succession by gravity flow. Each stage of the shaft has a feed gas stream which enters the bottom of the stage. Each stage also has an exit gas stream which leaves at the top of the stage. The treated solid 15 leaves the shaft 1 at the bottom of the sixth stage at a temperature in the range of 40° to 150° C.

An inert gas 2 is made by the carbon monoxide separation unit 3. This gas 2 is passed across the sixth stage to recover sensible heat from the down-coming solids and is then passed across the first stage of the vertical shaft 1 to pre-heat fresh solid 14. Spent inert gas 2 is exhausted to the atmosphere at 50° to 100° C.

Ambient air 4 is heated to the range of 400°–600° C. by passing it across the fourth stage of the shaft 1. Part of the resulting hot air is fed to the second stage where it burns the carbon-containing solid to pyrolyze-crack out an oil vapor which is mixed with a producer gas. The vapor oil and gas mixture is separated into the oil product 7 and a producer gas 6 by conventional apparatus 5. The solid passing from the second to the third stage has been heated by the combustion to 600°–700° C.

The rest of the hot air from the fourth stage is fed into the third stage. Here part of the non-volatile carbon in the solid is reacted with carbon dioxide 12 to form carbon monoxide. The rest of the non-volatile carbon in the solid is burned with air to form carbon monoxide and nitrogen. A producer gas 8 exits the third stage at 500°–600° C. The producer gas (carbon monoxide-rich) 8 is cooled to 100°–200° C. by passage through the fifth stage of the shaft 1. Substantial amounts of sulfur compounds and water are also removed from the gas 8 onto the solid in the fifth stage.

The cooled and purified carbon monoxide-rich producer gas 9 is fed to a separation unit 3 to make an inert gas stream 2, whose flow has already been described, and pure carbon monoxide 10. The carbon monoxide 10 is fed to a Boudouard reactor 11 at 400°–500° C. which converts the carbon monoxide into the product carbon and carbon dioxide. A separation part of the Boudouard reactor 11 makes a pure carbon product 13 and a hot carbon dioxide gas stream 12 at 450°–550° C. which is fed entirely into the bottom of the third stage of the shaft 1.

THE DRAWING

Figure 2:
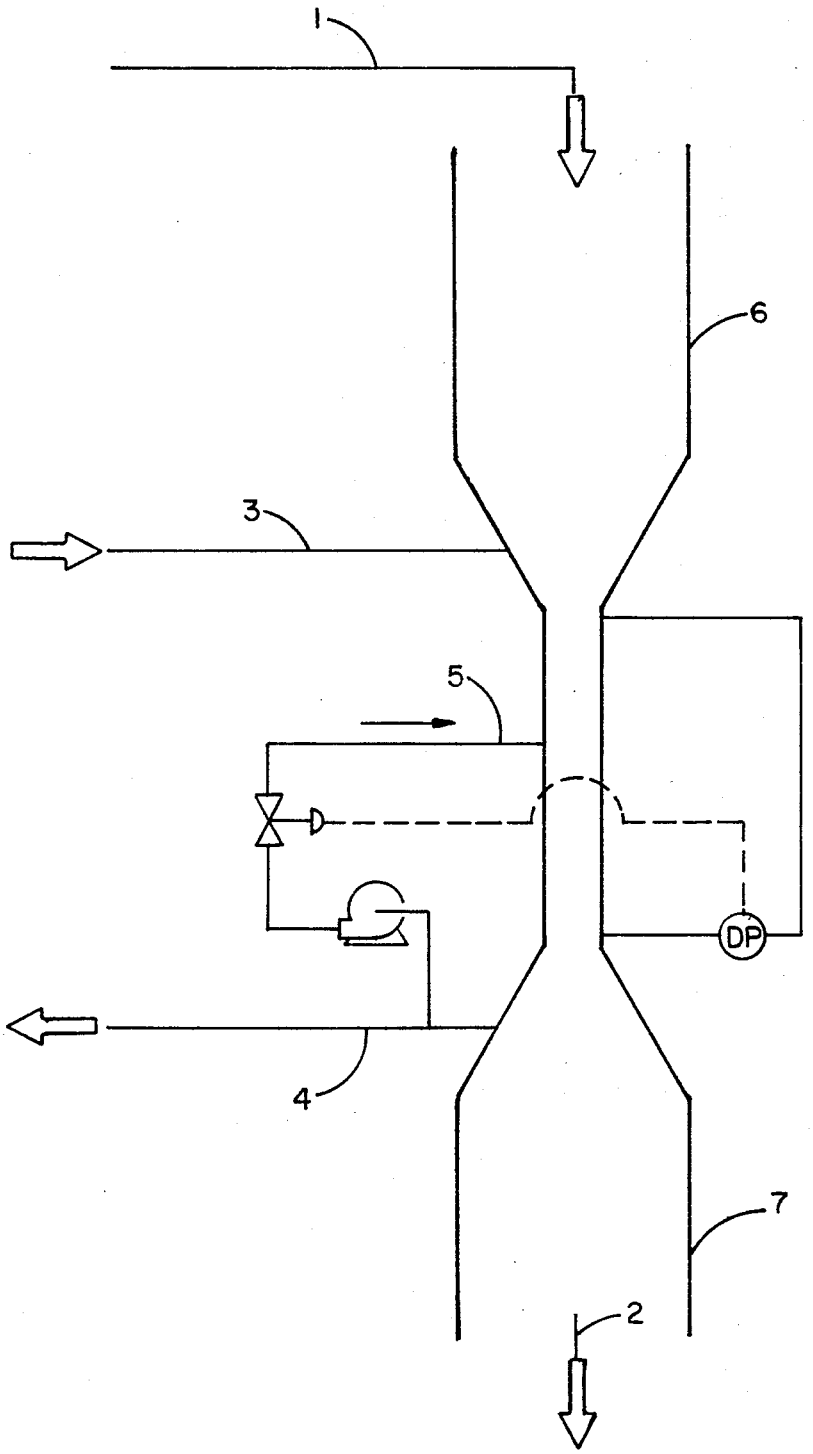

FIG. 2 shows any two connecting stages of the six stages of the vertical shaft 1 of FIG. 1 and diagrams a method of feeding part of the gaseous product stream of a stage to the narrow channel connecting the two stages so as to maintain the inter-stage gas flow between the two stages to an acceptable minimum.

Solid 1 descends through an upper stage 6 of the vertical shaft of FIG. 1 and enters the next lowest stage 7 by passing through the narrow part of the shaft separating the two stages. A differential pressure cell taps into the top and the bottom of the narrow passage. Any inter-stage gas flow is proportional to the square of the differential pressure of the cell. A blower fan feeds gas from the lower stage 7 outgas 4 into the narrow passage between stage 6 and 7. This recycle gas 5 is flow controlled by a control valve which is governed by the differential pressure cell. The recycle gas 5 flows through the narrow channel and causes a pressure drop in the narrow channel which acts to neutralize the inter-stage gas flow between the two stages.

Suitable devices as shown in FIG. 2 are installed between each stage of the vertical shaft 1 of FIG. 1. In FIG. 1, it is best to install and operate the devices described in FIG. 2 so that the shaft 1 of FIG. 1 has small gas flows from the first and third stages into the second stage; from the third and the fifth stages into the fourth stage; and from the sixth to the fifth stage of the vertical shaft 1.

THE STAGES OF THE VERTICAL SHAFT

As part of the detailed description, the stages of the vertical shaft will be described as to their function and approximate temperature ranges (from bottom to top of the stage). FIG. 1.

The actual temperatures of the process can and will vary according to the organic content of the solids processed, the composition of the organic matter and the amounts of calcium carbonate and magnesium carbonate in the processed solids.

| Stage of the Vertical Shaft | | Solids Temperature, °C. Top | Bottom |
|---|---|---|---|
| First | preheat, solid | 40 | 300 |
| Second | pyrolysis-combustion-distn. | 300 | 600 |
| Third | non-volatile C to CO | 600 | 700 |
| Fourth | air preheat | 700 | 150 |
| Fifth | cool-purify producer gas | 150 | 500 |
| Sixth | spent solid cooling | 500 | 100 |

What is claimed is:

1. A process for the production of oil, pure carbon (tar, sulfur and ash-free) and producer gas from carbon-containing solids which comprises:

(a) passing the said solid from the top to the bottom of a vertical shaft which is divided into six stages;

(b) passing an inert gas across the sixth stage (bottom) of the vertical shaft and then across the first stage (top);

(c) passing air across the fourth stage of the said shaft and then feeding the said air in part to the second stage and in part to the third stage of the said shaft;

(d) separating the gas product of the second stage into oil and a producer gas;

(e) feeding the gas product of the third stage through the fifth stage of the said shaft and then into a carbon monoxide separation unit;

(f) using the inert gas produced in the carbon monoxide separation unit as feed to the sixth stage of the said shaft;

(g) feeding the pure carbon monoxide product of the carbon monoxide separation unit to a Boudouard reactor;

(h) reacting carbon monoxide to carbon dioxide and carbon;

(i) separating the carbon from the carbon dioxide;

(j) feeding the carbon dioxide to the third stage of the said shaft; and (k) discarding the treated solid from the bottom (sixth) stage of the said shaft.

2. A method according to claim 1 except where part of the producer gas is fed into the bottom of the second stage of the said shaft.

* * * * *